US011732525B2

(12) United States Patent
Kendall et al.

(10) Patent No.: US 11,732,525 B2
(45) Date of Patent: Aug. 22, 2023

(54) DOOR SILL SYSTEM, APPARATUS, AND METHODS FOR A DOOR ASSEMBLY

(71) Applicant: Endura Products, LLC, Colfax, NC (US)

(72) Inventors: Adam Kendall, Burlington, NC (US); Tomasz Jaskiewicz, Oak Ridge, NC (US)

(73) Assignee: Endura Products, LLC, Colfax, NC (US)

( * ) Notice: Subject to any disclaimer, the term of this patent is extended or adjusted under 35 U.S.C. 154(b) by 0 days.

(21) Appl. No.: 17/591,437

(22) Filed: Feb. 2, 2022

(65) Prior Publication Data

US 2022/0243523 A1 Aug. 4, 2022

Related U.S. Application Data

(60) Provisional application No. 63/146,120, filed on Feb. 5, 2021, provisional application No. 63/144,713, filed on Feb. 2, 2021.

(51) Int. Cl.
*E06B 1/70* (2006.01)

(52) U.S. Cl.
CPC ..... *E06B 1/70* (2013.01); *E06B 2001/707* (2013.01)

(58) Field of Classification Search
CPC ..... E06B 1/70; E06B 2001/707; E06B 7/231
See application file for complete search history.

(56) References Cited

U.S. PATENT DOCUMENTS

| | | | | |
|---|---|---|---|---|
| 344,963 | A | 7/1886 | Hayes | |
| 1,207,827 | A | 12/1916 | Winters | |
| 1,729,243 | A | 9/1929 | Bricker | |
| 1,910,260 | A | 5/1933 | Reher | |
| 2,188,049 | A | 1/1940 | Kammerer | 20/64 |
| 2,722,724 | A | 11/1955 | Miller | 20/64 |
| 2,788,551 | A | 4/1957 | Hildreth | 20/64 |
| 2,848,766 | A | 8/1958 | Fulton | 20/64 |
| 2,875,481 | A | 3/1959 | Erkkila | 20/64 |
| 3,032,839 | A | 5/1962 | Miller | 20/64 |
| 3,079,652 | A | 3/1963 | Wahlfeld | 20/64 |
| 3,382,617 | A | 5/1968 | Aubin | 49/468 |
| 3,521,404 | A | 7/1970 | Hager | |
| 3,667,164 | A | 6/1972 | Coppins | 49/469 |

(Continued)

FOREIGN PATENT DOCUMENTS

| | | |
|---|---|---|
| CA | 2264357 | 9/2000 |
| CA | 2771705 | 2/2013 |

(Continued)

*Primary Examiner* — Janet M Wilkens
*Assistant Examiner* — Susan M. Heschel
(74) *Attorney, Agent, or Firm* — Womble Bond Dickinson (US) LLP

(57) ABSTRACT

A system, device, kit, assembly and methods for a frame assembly, including a door sill as shown and described. The assembly may be a door frame assembly and may, by way of example, be a door jamb and/or a door mullion including a door sill. In other embodiments, a door sill includes a base component having a slot, a deck component having a segment, and wherein the segment component press-fits within the slot to adjoin the base component and the deck component. Some inventions of the present disclosure may be considered a door sill having a press-fit removable deck.

12 Claims, 6 Drawing Sheets

(56) References Cited

U.S. PATENT DOCUMENTS

| | | | | |
|---|---|---|---|---|
| 4,476,653 | A | 10/1984 | Speer et al. | 49/468 |
| 4,831,779 | A | 5/1989 | Kehrli et al. | 49/471 |
| 5,010,690 | A | 4/1991 | Geoffrey | 49/468 |
| 5,067,279 | A | 11/1991 | Hagemeyer | 49/471 |
| 5,179,804 | A | 1/1993 | Young | 49/471 |
| 5,426,894 | A | 6/1995 | Headrick | 49/468 |
| 5,553,419 | A | 9/1996 | Jenkins, II | |
| 5,588,266 | A | 12/1996 | Headrick | 52/204.1 |
| 5,611,173 | A | 3/1997 | Headrick et al. | 49/468 |
| 5,943,825 | A * | 8/1999 | Procton | E06B 7/2316 49/470 |
| 6,125,599 | A | 10/2000 | Mees et al. | 52/204.5 |
| 6,216,395 | B1 | 4/2001 | Kelly | 49/467 |
| 6,269,591 | B1 | 8/2001 | Kelly | 49/482.1 |
| 6,289,635 | B1 | 9/2001 | Procton et al. | |
| 6,345,477 | B1 | 2/2002 | Kepler et al. | 52/204.1 |
| 6,484,446 | B2 | 11/2002 | Young | 49/469 |
| 7,266,929 | B1 | 9/2007 | Allred et al. | 52/211 |
| 7,389,611 | B2 | 6/2008 | Palenske | 49/468 |
| 8,413,383 | B2 | 4/2013 | Van Camp et al. | 49/468 |
| 8,443,554 | B1 | 5/2013 | Teodorovich | 49/506 |
| 8,490,332 | B2 * | 7/2013 | Van Camp | E06B 1/70 49/468 |
| 8,522,483 | B2 | 9/2013 | Van Camp et al. | |
| 8,567,128 | B2 | 10/2013 | Van Camp et al. | 49/468 |
| D701,323 | S | 3/2014 | Fortun | |
| 8,991,100 | B2 | 3/2015 | Van Camp et al. | |
| 8,991,101 | B2 | 3/2015 | Van Camp et al. | |
| 9,051,777 | B2 | 6/2015 | Van Camp et al. | |
| 9,371,682 | B2 | 6/2016 | Van Camp et al. | |
| 9,528,314 | B2 | 12/2016 | Mitchell et al. | |
| 9,624,716 | B2 | 4/2017 | Mitchell et al. | |
| 9,725,945 | B2 | 8/2017 | Swank et al. | |
| 9,874,054 | B2 | 1/2018 | Mitchell et al. | |
| 10,066,433 | B2 | 9/2018 | Van Camp et al. | |
| 10,202,795 | B2 | 2/2019 | Swank et al. | |
| 10,407,975 | B2 | 9/2019 | Van Camp et al. | |
| 10,612,291 | B2 * | 4/2020 | Bryant | E06B 1/70 |
| 10,697,228 | B2 | 6/2020 | Swank et al. | |
| 11,047,165 | B1 * | 6/2021 | Monts De Oca | E06B 1/70 |
| 2002/0194788 | A1 | 12/2002 | Bennett | |
| 2005/0198911 | A1 | 9/2005 | Baczuk et al. | 49/504 |
| 2006/0005470 | A1 | 1/2006 | Mullen | |
| 2006/0096190 | A1 | 5/2006 | Baczuk et al. | 52/204.1 |
| 2006/0150521 | A1 | 7/2006 | Henry et al. | 49/471 |
| 2006/0174545 | A1 | 8/2006 | Young | 49/468 |
| 2008/0120914 | A1 | 5/2008 | Fink et al. | 49/469 |
| 2008/0229669 | A1 | 9/2008 | Abdollahzadeh | |
| 2009/0199486 | A1 | 8/2009 | Wernlund et al. | 49/471 |
| 2013/0199100 | A1 | 8/2013 | Van Camp | |
| 2013/0276376 | A1 | 10/2013 | Gilbert et al. | 49/469 |
| 2015/0308180 | A1 | 10/2015 | Meeks | |
| 2016/0273260 | A1 | 9/2016 | Jolie et al. | 7/14 |
| 2017/0058592 | A1 | 3/2017 | Meeks | |
| 2017/0342764 | A1 * | 11/2017 | Headrick | E06B 7/2312 |
| 2018/0100345 | A1 | 4/2018 | Meeks | |
| 2018/0274244 | A1 | 9/2018 | Ortega | |
| 2019/0218849 | A1 | 7/2019 | Bryant | |
| 2020/0024889 | A1 | 1/2020 | Mitchell | |
| 2020/0048954 | A1 | 2/2020 | Wang | |

FOREIGN PATENT DOCUMENTS

| | | | |
|---|---|---|---|
| CA | 2851461 | 11/2014 | |
| CA | 2928085 | 11/2016 | |
| CA | 2928089 | 11/2016 | |
| EP | 0723063 | 5/1995 | E06B 1/70 |
| EP | 0736660 | 4/1996 | E06B 1/70 |
| EP | 0789128 | 2/1997 | E06B 1/70 |
| EP | 0723061 | 8/1998 | E06B 1/70 |
| EP | 1001127 | 11/1999 | E06B 1/70 |
| EP | 0819816 | 1/2001 | E06B 1/70 |
| EP | 1186740 | 3/2002 | |
| EP | 1270861 | 6/2002 | E06B 1/70 |
| EP | 1087090 | 10/2002 | E06B 1/70 |
| EP | 1516991 | 9/2004 | E06B 1/70 |
| GB | 2121465 | 12/1983 | E06B 1/70 |
| GB | 2259933 | 7/1991 | E06B 1/70 |

* cited by examiner

DOOR SILL SYSTEM, APPARATUS, AND METHODS FOR A DOOR ASSEMBLY

This application claims the benefit of U.S. provisional application No. 63/144,713, filed Feb. 2, 2021, and U.S. provisional application No. 63/146,120, filed Feb. 5, 2021, which are incorporated herein by reference in its entirety.

FIELD OF TECHNOLOGY

The present disclosure relates generally to doors and door assemblies having a door sill for entranceways, for example, for a building and, more particularly, to a door sill system, device, apparatus, and/or methods for a door sill assembly for a residence/facility.

BACKGROUND

A door sill takes constant and repeated traffic, weathering and abuse. Some parts of a door sill may age faster or slower than others and/or may be the focal point of more traffic flow. Important variables in door sill applications are a secure fit, durability and expense. In some attempts, door sills have been made one piece to be more durable. However, one piece door sills remain expensive, may still wear in certain areas more than others, may not provide a desirable fit over time, or become damaged in certain areas of the sill.

One consideration, especially with more than one-piece sills is water penetration, weathering and secure fit. Traditional sills are typically too expensive, lack desired durability, and/or are not as weather resistant as desired. Thus, the Applicant recognized there remains a need for a cost effective, durable door sill that resists foot traffic, weathering, and long-term exposure to moisture.

SUMMARY

The present disclosure is directed in one embodiment to a system, device, apparatus, method and/or kit for a door sill assembly for a doorway.

In some embodiments, a door sill having a deck, may include a molded base component and a deck component fitting with the molded base component.

Embodiments may include, a door sill having a base component, including a first end, a second end, a top and a bottom and a deck component, including a deck first end, a deck second end, a deck top, and a deck bottom. A slot may be formed in the base component. A segment may extend from a deck component. A slot and a segment may be adapted to mate with one another and together form a press-fit securing tension securing the deck component to the base component.

A door sill may be a one-piece door sill. The door sill may be a two-piece assembled door sill. A top surface on the deck top may include a set of raised treads.

In certain examples, a base component may include a slot. The slot may be a recess extending inwardly into the base component along an inside. The recess may divide the inside into an upper inside and a lower inside. The upper inside and the lower inside may align in the same plane vertically. A deck component may include a segment. The segment may extend outwardly from the deck inside. The segment may include a first arm and a second arm. The first arm and the second arm may be connected by a rounded end. The segment may be a U-shaped segment. The segment may be tensioned so that a distance between the first arm and the second arm is greater than the distance between inside parallel walls of the slot. The first arm and second arm are therefore press-fit into the slot and create a tension lock inside the slot between the slot and the segment.

Some examples may include a cover. The cover may secure with the base. The cover may provide a barrier along the top of the base portion. The cover may extend along a proximal surface of the base portion and into the slot.

A seal may include a seal attachment and a seal attachment portion. The seal attachment portion may fit and be secured inside the segment within the slot. A seal top may extend upwards past a top of the base portion and past a deck top.

The door sill may, in other examples, include a caulking surface on the underside of the base portion. The caulking surface may be integral with the base portion and/or may be an attachment that secures with the deck. A caulking surface may, also or alternatively, be included as an extended length of the base portion.

In one example, a base component may be an injection molded base component.

In one example, the deck component may be an extruded aluminum deck component.

Embodiments may include a door sill where a deck component is removable from a molded base component. A second deck component may be configured to be replaceable with the deck component, such that the second deck component may mate with the base component.

The inventions of the present disclosure may be considered a method for a door sill for a doorway by way of any of the embodiments disclosed.

One example may include a kit for a door sill according to any of the embodiments disclosed herein. In one example of a kit, the kit may include a door sill having a deck component and a base component.

These and other aspects of the inventions of the present disclosure will become apparent to those skilled in the art after a reading of the following description of embodiments when considered with the drawings.

DESCRIPTION OF EMBODIMENTS

Figure 1:
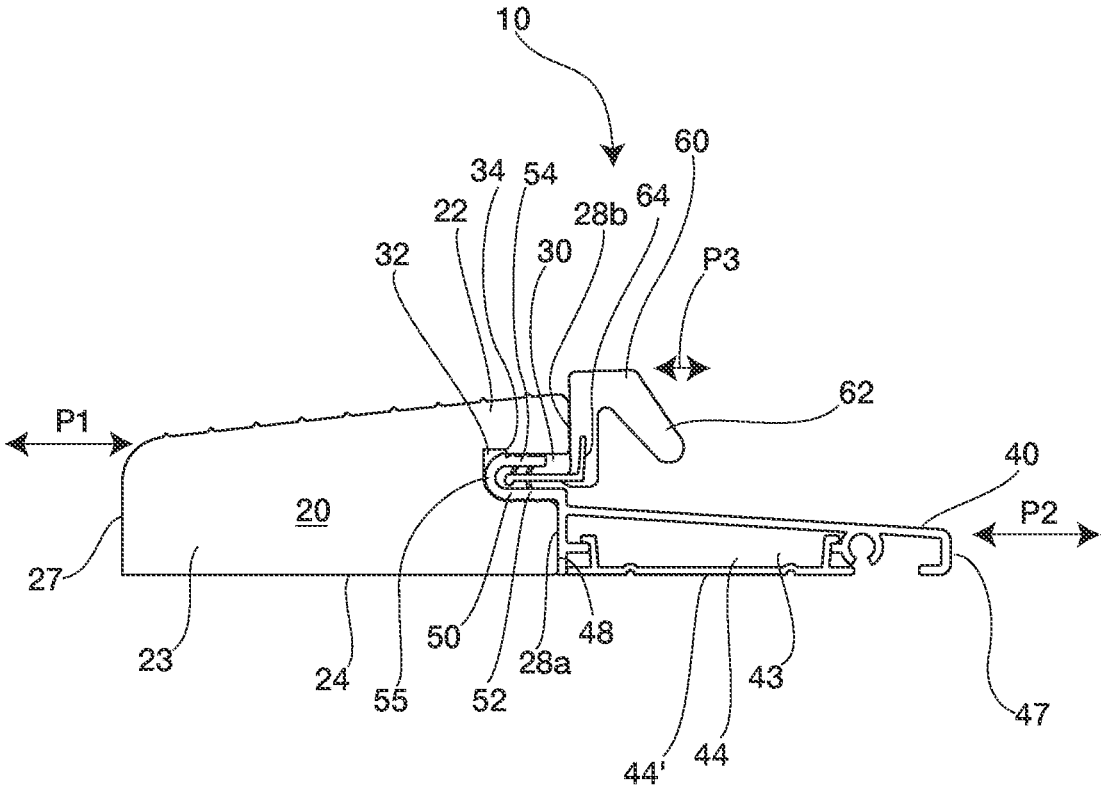
FIG. 1 is an end view of one embodiment of a door sill assembly for a doorway constructed according to the present disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

A door frame often includes one or more frame members. A plurality of frame members may include any combination of a header, a sill, mullion components, jamb components, and/or a trim profile. A header may be generally placed toward the top of a door assembly. Mullions and jambs components may be generally placed at opposing sides of a door assembly. Frame assemblies may also include hinges for connecting door panels to at least one of the frame members. The frame assembly may also include locking hardware that enables the door to be secured to as least one of the frame members and/or to another door. Locking hardware, by way of example, may include latches and deadbolts. Toward the bottom of a doorway typically is a door sill assembly.

Referring now to the drawings in general, it will be understood that the illustrations are for the purpose of describing a preferred embodiment of the inventions and are not intended to limit the inventions thereto. Shown throughout FIGS. 1-3, and referencing a door sill 10, in some embodiments, a door sill 10 may include a base component 20 and a deck component 40 for fitting with the base component 20. The base component 20 may, by way of example, be a molded base component, injection molded polymer base component, and/or an extruded substrate.

A base component 20 may include a first end 23 and a second end 25. The base component may include a top 22, bottom 24, distal surface 27 and proximal surface 28. The top 22 of base component 20 may form a surface plane P1 along the top 22. The base component 20 may include a slot 30. The slot 30 may recess into the proximal surface 28 of deck component 20.

The slot 30 may include an upward indentation 32 inside the slot 30. The upward indentation may form a slot edge 34. The indentation may also be a downward indentation on an opposite side of the slot.

A deck component 40 may fit with the base component 20. In some examples, deck component 40 may press-fit with the base component 20. The deck component 40 may include, in some examples, a first end 43, a second end 45, a deck top 42, and a deck bottom 44. A deck top 42 may form a plane surface P2. The top 42 may include a set of raised treads. The deck component 40 may include a deck distal surface 47 and a deck proximal surface 48. The deck component may include a segment 50. Segment 50 may extend past deck proximal surface 48 and fit with slot 30 of base component 20. Segment 50 may snap into and be secured with slot 30. Segment 50 may include a first arm 52 and a second arm 54. Segment 50 may form a hook-shape with first arm 52 extending from deck proximal surface 48, forming a curved end 55 that extends to a second arm 54. First arm 52 may extend parallel to second arm 54. The first arm 52 and second arm 54 may be tensioned to form a pressure-fit with the slot 30 when inserted into slot 30, such that the pressure-fit secures the deck portion 40 with the base portion 20. The segment 50 may, in some examples, be considered a U-shaped segment.

The first arm 52 may include barbs 58 that extend outwardly from first arm 52 along the arm length. The second arm 54 may include barbs 58 that extend outwardly from second arm 54 along the arm length. In one example, a barb extending outwardly from second arm 54 may mate with the slot edge 34 of slot 30. The barb 58 that mates with slot edge 34 may hook onto the slot edge to secure the segment 50 within the slot 30. The pressure-fit tension of the segment 50 within the slot 30 may urge the barb 58 into upward indentation 32 and to lock onto slot edge 34. The segment 50 may be removably secured into slot 30 so that deck portion 40 is removably attached to base portion 20.

The proximal surface 28 of base portion 20 may include an upper proximal surface 28*b* and a lower proximal surface 28*a* separated by the slot 30. The deck proximal surface 48 of deck portion 40 may mate with base portion 20 along lower proximal surface 28*a* and along the slot 30, however, in some examples, may not mate with upper proximal surface 28*b*.

A seal 60 may include a seal portion 62 and an attachment portion 64. The seal portion 62 may form a weatherstrip seal. The attachment portion 64 may include projections 65 that secure the attachment portion 64 into the slot 30, and in some examples, inside a hook formed by segment 50. The seal portion 62 may be supported by the upper proximal surface 28*a*. The seal portion may include a seal top 68. Seal top may form a plane surface P3. Plane surface P3 may be situated higher than either plane P1 or plane P2 individually, and/or plane P3 may be situated higher off a ground surface G than either P1 or P2. In some examples, plane P3 is raised above plane P1 so that plane P3 extends above plane P1.

Some embodiments include a base component 20 having an integrated slot 30 configured to accept a segment 50 of a deck portion 40, the segment 50 being configured to accept a seal 60. Such a configuration provides a press-fit deck portion 40 and base portion 20.

Figure 4:
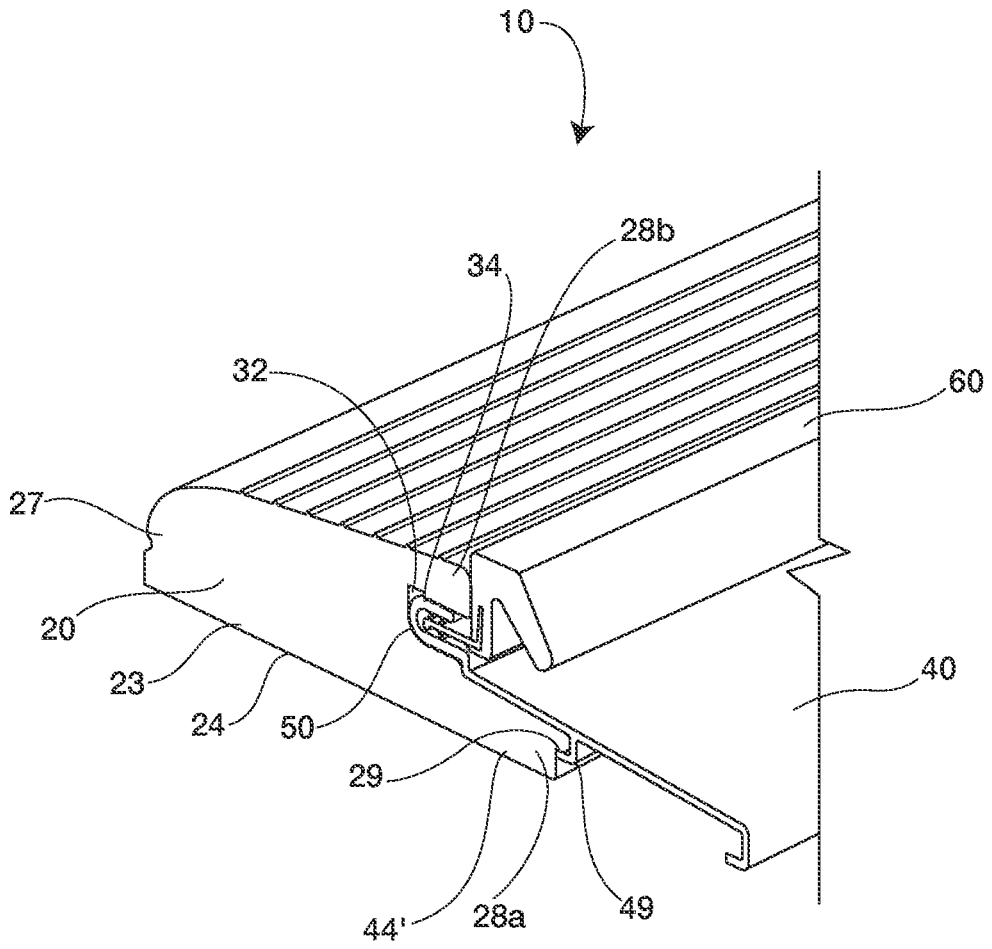
FIG. 4 is an end perspective view of another embodiment of a door sill assembly for a doorway constructed according to the present disclosure.
Figure 5:
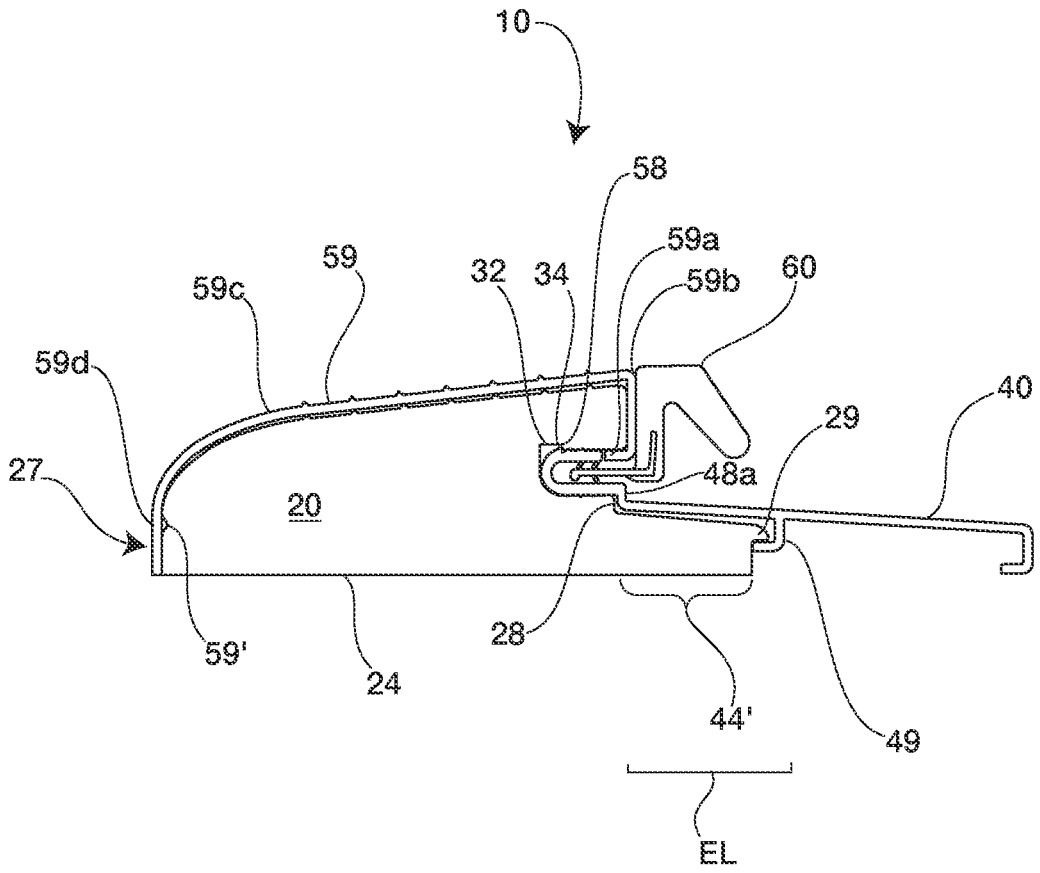
FIG. 5 is an end view of one example of the door sill assembly according to FIG. 4.
Figure 6:
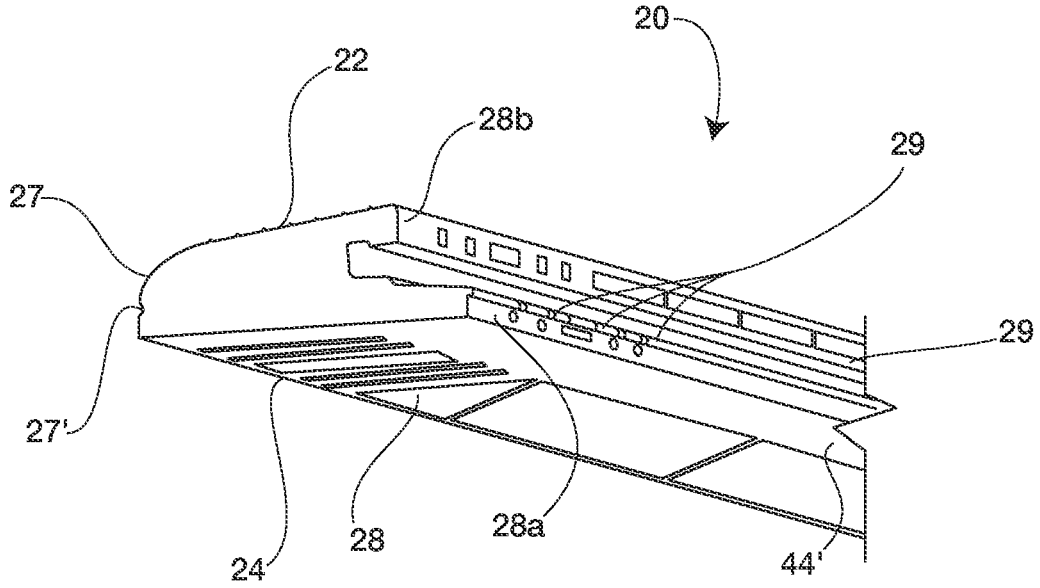
FIG. 6 is an end perspective view of one example of a door sill assembly base portion according to FIG. 4.

Examples of this embodiment, some of which are seen in FIGS. 4-6, may include a base component 20 having an extended length EL extending from proximal surface 28*a*. Proximal surface 28*a* may form a ledge 48*a* declining to extended length EL. Extended length EL may included a projecting lip 29. Deck portion 40 may include a hook 49, the hook 49 and projecting lip 29 mating to form a hook and lip connection, where the hook 49 hooks under lip 29 to assist in securing the deck portion 40 to the base portion 20 along with the press-fit connection of the slot 30 and segment 50. Lip 29 may be continuous or may be segmented, by way of example.

Embodiments may include a cover 59. Cover 59 may be continuous with deck portion 40, may be separate from deck portion 40, and/or may interface with deck portion 40, in some examples, to cover a substantial portion of base portion 20. Cover 59 may include a segment cover 59*a*, a proximal cover 59*b*, a top cover 59*c*, a distal cover 59*d*, and/or a cover projection 59'. The cover 59 may be secured with base portion 20, at least in part, by a combination of segment cover 59*a* extending into slot 30 and hooking around proximal surface 28*b*, in conjunction with a cover projection 59' mating with base portion 20 at base recess 27'.

Figure 2:
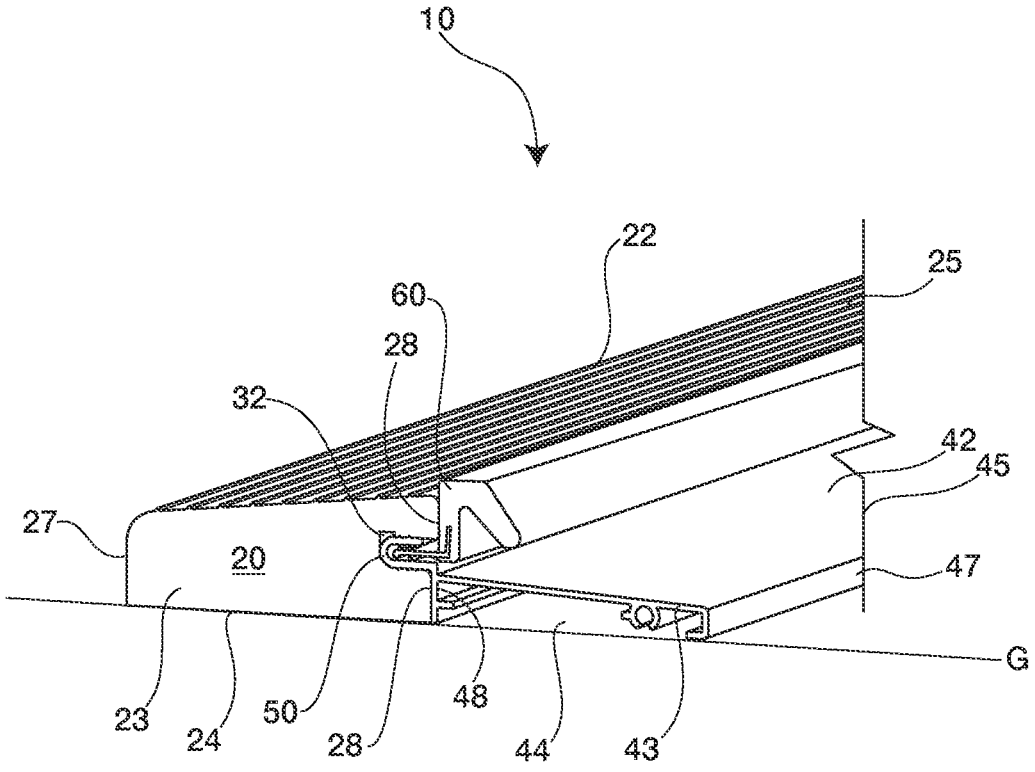
FIG. 2 is an end perspective view of one embodiment of the door sill assembly of FIG. 1.
Figure 3:
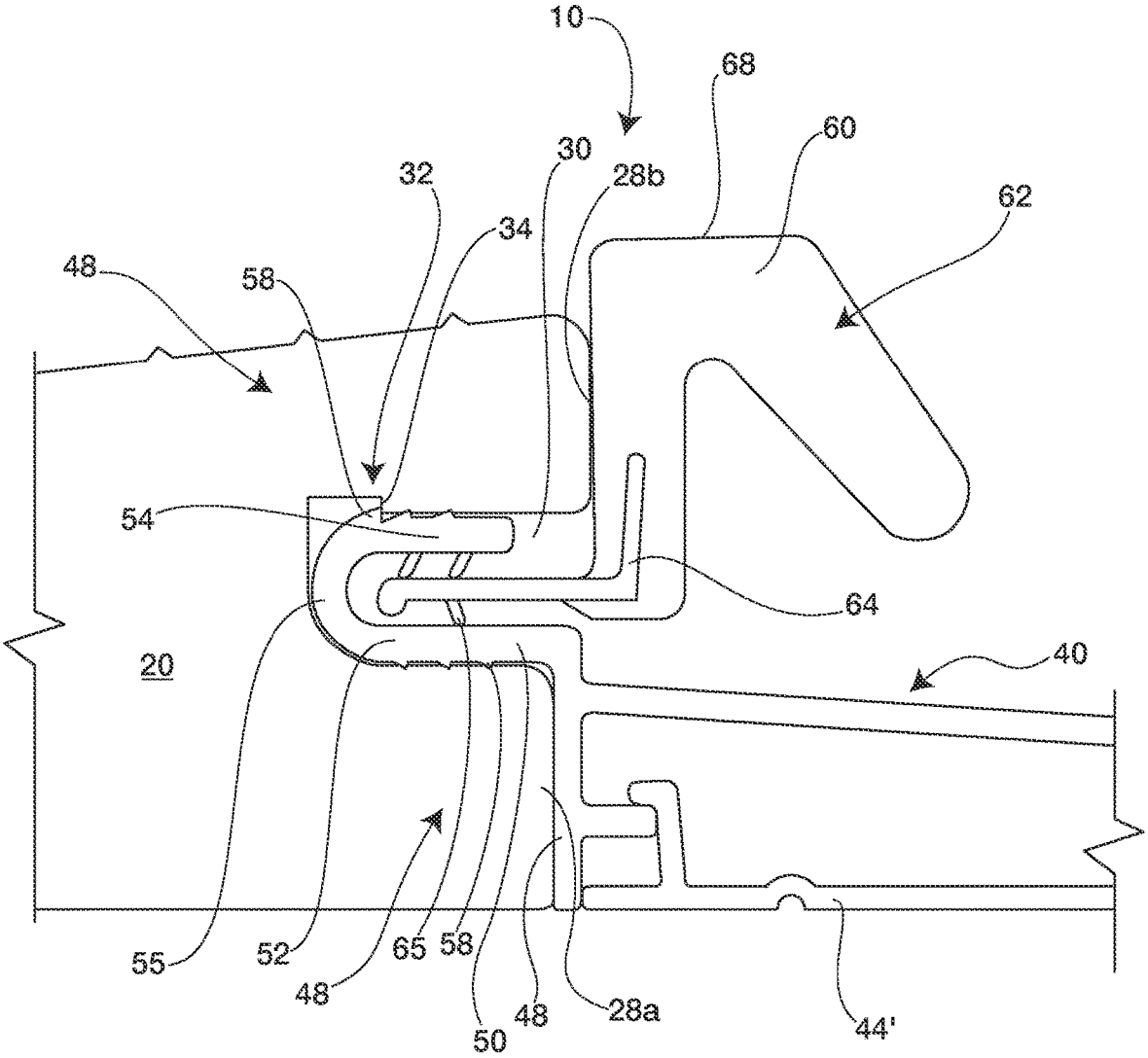
FIG. 3 is a close-up end view of one embodiment of the door sill assembly of FIG. 1.

In some examples of FIGS. 1-3, a deck portion 40 may include a caulking strip 44' along a deck bottom 44. The caulking strip 44' may fit with deck portion 40. The caulking strip may be snap-fitted with deck portion 40. The caulking strip 44' may be removable in some instances. The caulking strip may be used for application of caulking to provide improved weatherproofing and or to assist in securing the deck 40 along the ground surface G.

In other examples, referencing FIGS. 4-6, a base portion 20 may include a caulking strip 44'. A caulking strip associated with base portion 20 may include an extended length EL, extending beyond proximal surface 28. The extended length EL may provide a bottom 24 to serve as a caulking strip. The extended length EL may be integral with base 20.

In one example, the deck component 40 may be an extruded aluminum deck component. In an example including a molded polymer base component and an extruded aluminum deck component, structured according to any of the embodiments disclosed, the door sill 10 maintains a secure fit with a door panel, minimizes materials needed for construction of the sill, is durable and damage resistant and is cost effective, reducing production cost of the door sill 10.

In other examples, the door sill 10 may be considered a one-piece fixed sill with an aluminum deck secured thereto. In other examples, the door sill 10 may be considered a two-piece door sill.

Some embodiments may include wherein a deck component 40 is removable from a base component 20. In some instances, deck component 40 may be interchangeable with a replacement deck component 40.

The inventions of the present disclosure may be considered a method for a door sill 10 for a doorway by way of any of the embodiments disclosed. The inventions also include a method for an economical door sill 10.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A door sill comprising:

a base component, including:

a first end, a second end, a top and a bottom;

a deck component, including: a deck first end, a deck second end, a deck top, and a deck bottom;

a slot formed in the base component and having an upward indentation, a segment extending from said deck component and having a curved end between a first arm and a second arm, wherein said slot and said segment are adapted to mate with one another and together form a press-fit securing tension securing the deck component to the base component;

at least one barb extending outwardly from one of the first arm or the second arm, wherein the at least one barb mates with the upward indentation and the press-fit of the first arm and second arm tensioned to press against the inside walls of the slot combining to secure the deck component with the base component.

2. The door sill of claim 1, wherein said base component is injection molded.

3. The door sill of claim 1, wherein said base component is an extruded substrate.

4. The door sill of claim 1 wherein said deck component is an extruded aluminum deck.

5. The door sill of claim 1, wherein said deck component is adjoined to a molded base component, and mates with the molded base component to form a two-piece assembled door sill.

6. The door sill of claim 1 wherein said segment is a U-shaped segment.

7. The door sill of claim 1 including an indentation.

8. The door sill of claim 7 wherein said indentation is an upward indentation.

9. The door sill of claim 7 wherein said indentation is a downward indentation.

10. The door sill of claim 1 wherein said at least one barb hooks onto the upward indentation to secure the segment within the slot.

11. The door sill of claim 1 including a plane formed from a top, a plane formed from a deck top, and a plane formed by a seal top, wherein the plane formed by a seal top is higher from a ground surface than the plane formed from a deck top or the plane formed by the top.

12. A door sill comprising:

a base component, including:

a first end, a second end, a top and a bottom;

a deck component, including: a deck first end, a deck second end, a deck top, and a deck bottom;

a slot formed in the base component, wherein said base component includes an extended length caulking strip;

a segment extending from said deck component, wherein said slot and said segment are adapted to mate with one another and together form a press-fit securing tension securing the deck component to the base component;

a cover, wherein said cover secures to said base portion at least in part by way of a segment cover extending into the slot and hooking around a proximal surface in conjunction with a cover projection mating with the base portion at a base recess.

* * * * *